US006167990B1

(12) United States Patent
Peng

(10) Patent No.: US 6,167,990 B1
(45) Date of Patent: Jan. 2, 2001

(54) LUBRICATING DEVICE FOR FOUR-STROKE ENGINE

(75) Inventor: Yu-Yin Peng, Hsin-Chu (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/243,788

(22) Filed: Feb. 3, 1999

(51) Int. Cl.[7] ..... F01M 11/06

(52) U.S. Cl. ..... 184/6.2; 184/6.5; 184/106; 123/196 W

(58) Field of Search ..... 184/6.2, 6.5, 15.2, 184/106; 123/196 R, 196 S, 196 W, 73 AD

(56) References Cited

U.S. PATENT DOCUMENTS

| | | | | |
|---|---|---|---|---|
| 821,915 | * | 5/1906 | Altham | 184/6.5 |
| 1,026,287 | * | 5/1912 | Taylor et al. | 184/6.5 |
| 1,286,345 | * | 12/1918 | Kirkham | 184/6.2 |
| 1,303,622 | * | 5/1919 | Williams | 184/6.5 |
| 1,396,050 | * | 11/1921 | Palmer | 184/106 |
| 2,060,752 | * | 11/1936 | Celander et al. | 184/6.5 |
| 2,150,487 | * | 3/1939 | Brown | 184/6.5 |
| 2,938,601 | * | 5/1960 | Brafford | 184/6.2 |
| 3,590,953 | * | 7/1971 | Wellauer | 184/106 |
| 3,638,760 | * | 2/1972 | Lamm | 184/106 |
| 4,296,716 | * | 10/1981 | Hofbauer et al. | 184/106 |
| 4,346,786 | * | 8/1982 | Midgley | 184/6.2 |
| 4,378,763 | * | 4/1983 | Ishihama | 184/106 |
| 4,523,556 | * | 6/1985 | Suzuki | 123/196 W |
| 4,583,416 | * | 4/1986 | Muller | 184/6.2 |
| 4,616,609 | * | 10/1986 | Munch et al. | 184/106 |
| 4,909,203 | * | 3/1990 | Fukuo | 123/196 R |
| 5,014,819 | * | 5/1991 | Gotou et al. | 184/6.2 |
| 5,411,116 | * | 5/1995 | Kish et al. | 184/6.2 |
| 5,960,763 | * | 10/1999 | Yamamura | 123/196 R |
| 5,960,764 | * | 10/1999 | Araki | 123/196 R |
| 5,964,198 | * | 10/1999 | Wu | 123/196 R |

FOREIGN PATENT DOCUMENTS

| | | | | |
|---|---|---|---|---|
| 408537 | * | 9/1966 | (CH) | 184/6.2 |
| 466157 | * | 5/1914 | (FR) | 184/6.2 |
| 174229 | * | 1/1922 | (GB) | 184/6.2 |
| 58-113521 | * | 7/1983 | (JP) | 184/106 |

* cited by examiner

*Primary Examiner*—David A. Bucci
*Assistant Examiner*—Chong H. Kim

(57) ABSTRACT

An improved lubricating device for a four-stroke engine which permits the engine to operate upside down for a longer time and which has a better lubricating effect. This device comprises a first partitioning portion dividing the lubricating oil reservoir into a first and a second chambers, and a second partitioning portion further dividing the second chamber into a first and a second sub-chambers. The first partitioning portion includes a concave portion, having an opening for communicating the first chamber with the second chamber, which is adapted to receive some lubricating oil. Also, the first partitioning portion is provided thereon with a check valve which allows irreversible flow of the lubricating oil mist between the first chamber and the second sub-chamber. Moreover, this invention provides a complete circulation path for lubricating oil wherein the lubricating oil is transferred from the first chamber to the rocker chamber, then enters the main shaft chamber and finally returns back to the first chamber, thereby fully lubricating all the parts in the engine and greatly improving the lubricating effect.

5 Claims, 8 Drawing Sheets

LUBRICATING DEVICE FOR FOUR-STROKE ENGINE

FIELD OF THE INVENTION

This invention relates to an improved lubricating device for four-stroke engines and, more particularly, to a lubricating device which permits the engine to operate in an inverted state for a longer time and which has a much better lubricating effect.

DESCRIPTION OF THE RELATED ART

Engines are frequently used in mowers, sawing machines, pumps and exhaust fans etc. Two stroke engines apt to cause air pollution, are gradually being replaced with engines four-stroke which serve as power sources of the aforementioned machines.

A conventional four-stroke engine is usually operated in an upright state. However, for an engine used in a hand-held machine such as a mower, a sawing machine etc, it is sometimes operated in a slightly tilted state or even in a completely inverted state due to functional requirements. In this case, a large quantity liquid of lubricating oil will accumulate on the one side of the piston opposite to the combustion chamber, which not only hinders the displacement of the piston but also leads to a bad lubricating effect.

The construction of a conventional four-stroke engine (in an upright state) will now be illustrated by referring to FIG. 1. This conventional engine includes a cylinder 20 provided therein with a piston 15, a connecting rod 21, and an inlet valve (an exhaust valve) 13. A rocker chamber Vr is connected to the upper end of the cylinder 20 and is adapted to receive the rockers 12 (only one is shown in FIG. 1) adapted to drive the inlet valve (or the exhaust valve) 13 through the swinging motion thereof. A main shaft 1 for transmitting the kinetic energy generated by the engine is rotatably supported by a pair of bearings 4, 5 mounted in a main shaft chamber Vs. A crank 14 fixed to one end of the main shaft 1 is rotatably connected to the connecting rod 21. A pair of gears 6 and 7 mounted on the main shaft 1 and another parallel shaft 3, respectively, engage with each other. A cam 8 is also mounted on the shaft 3. Consequently, when the cam 8 is driven by the main shaft 1 through the engagement of the gear pair 6 and 7, it will swing a rocker 9 which, in turn, raise or lower a link 10 and thus swing the rocker 12 having one arm connected to the link 10. As a result, the rotation of the main shaft 1 causes the opening or closing movement of the inlet valve (or the exhaust valve) 13. The link 10 is received within a sleeve 11 which communicates the rocker chamber Vr with the main shaft chamber Vs. A lubricating oil reservoir 17, adapted to receive liquid lubricating oil L therein, is connected to the lower end of the cylinder 20. A stirrer 16, attached to the lower portion of the connecting rod 21, is adapted to splash the liquid lubricating oil L in the lubricating oil reservoir 17.

Next, the operation (particularly the circulation of lubricating oil) of the above conventional engine will be explained below.

During the operation of the engine, the stirrer 16 keeps on moving up and down following the reciprocal movement of the connecting rod 21, and splashes the liquid lubricating oil in the lubricating oil reservoir 17. Some of the splashed lubricating oil enters the main shaft chamber Vs via the clearance and lubricates the parts 3, 4, 5, 6, 7, 8, 9, 10 of the engine. Some lubricating oil mist further enters the rocker chamber Vr through the clearance between the sleeve 11 and the link 10, thereby lubricating the rocker 12 and other parts.

Since the circulation route taken by the lubricating oil (mist), as explained above, is a single route, lubrication achievable by such a lubricating system is not effective enough.

In the case when the engine is operated in an upright state as shown in FIG. 1, most of the liquid lubricating oil is received in the lubricating oil reservoir 17. However, when the engine is operated upside down as shown in FIG. 2, most of the liquid lubricating oil moves to accumulate over the piston 15 and impedes the displacement of the piston 15. Besides, the stirrer 16 fails to function, leading to a poor lubrication of the engine parts. Thus, the lubrication effect is even poorer than in the case when the lubricating system of the engine is operated in an upright state.

SUMMARY OF THE INVENTION

In order to solve the above problems, this invention therefore provides an improved lubricating device for four-stroke engines which can be operated upside down for a longer period of time and which has a better lubricating effect.

In accordance with the first aspect of the present invention, there is provided an improved lubricating device for a four-stroke engine, the engine including a cylinder provided with inlet valve(s) and exhaust valve(s) therein, rockers for driving the inlet valve(s) and the exhaust valve (s), a rocker chamber connected to the upper end of the cylinder and adapted to receive the rockers, a main shaft for transmitting to outside the kinetic energy generated by the engine, a main shaft chamber communicating with the rocker chamber and adapted to rotatably support the main shaft, and a lubricating oil reservoir having a bottom wall and a side wall and adapted to receive lubricating oil therein. A first partitioning portion divides the lubricating oil reservoir into a first chamber positioned on one side of the first partitioning portion opposite to the bottom wall of the lubricating oil reservoir, and a second chamber located on the other side of the first partitioning portion. The first partitioning portion includes at least one concave portion for receiving the lubricating oil, and at least one opening, provided in the concave portion, which communicates the second chamber with the first chamber.

In addition to the above construction of an improved lubricating device for a four-stroke engine according to the first aspect of this invention, the improved lubricating device according to the second aspect of this invention may further comprise second partitioning portion connecting the side wall of the lubricating oil reservoir and the first partitioning portion so as to further divide the second chamber into a first sub-chamber under the second chamber containing the lubricating oil and a second sub-chamber positioned over the second chamber without lubricating oil therein.

In addition to the above construction of the improved lubricating device for a four-stroke engine according to the second aspect of this invention, the improved lubricating device according to a third aspect of this invention may further comprise check valve provided on the part of the first partitioning portion surrounding the second sub-chamber, which permits the irreversible flow of the lubricating oil mist from the first chamber into the second sub-chamber; a first conduit adapted to communicate the second sub-chamber with the rocker chamber; and a second conduit adapted to communicate the first chamber with the main shaft chamber.

In addition to the above construction of the improved lubricating device for a four-stroke engine according to the second aspect of this invention, the improved lubricating device according to a fourth aspect of this invention may further comprise check valve provided in the part of the first partitioning portion surrounding the second sub-chamber, which permits the irreversible flow of the lubricating oil mist from the first chamber into the second sub-chamber; a first conduit adapted to communicate the second sub-chamber with the rocker chamber; an intake tube which penetrates through and is held by the bottom wall of the lubricating oil reservoir surrounding said first sub-chamber, said intake tube having a first end jutting out of the oil level of lubricating oil when the engine is operated in an upright state and a second end protruding outside of the engine; and a second conduit adapted to communicate said second end of said second intake tube with the main shaft chamber.

DETAILED DESCRIPTION OF PREFERRED EMBODIMENTS

Figure 1:
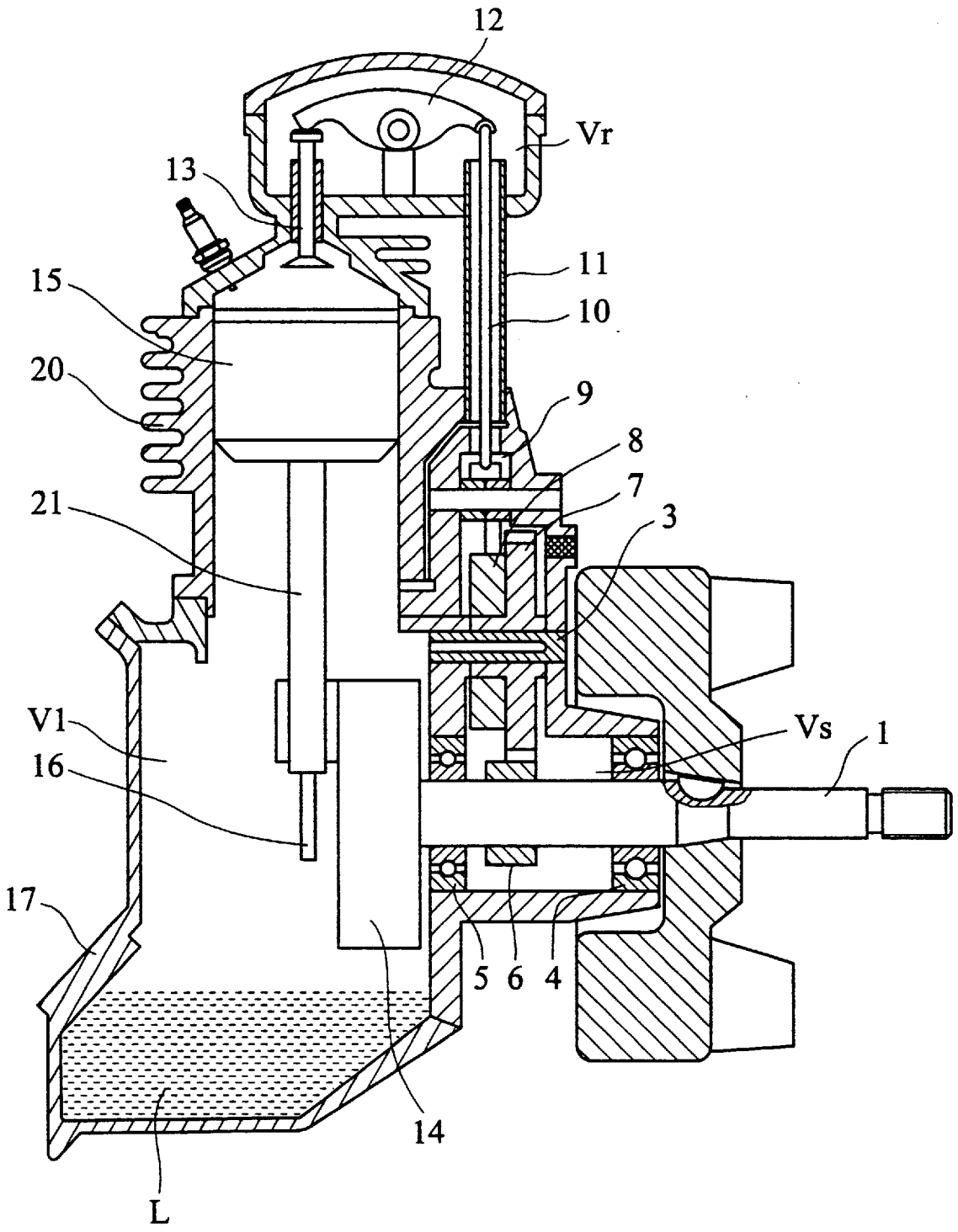
FIG. 1 (PRIOR ART)
FIG. 1 is a sectional view of a conventional four-stroke engine in an upright state.

The upward, downward, left and right directions mentioned in the illustration hereunder are based on the direction of the accompanying drawings so that it corresponds with the figures showing the device operated in an upright or an inverted position.

It should be noted that a like member or portion has been denoted by a like reference numeral or symbol in the figures, and repeated explanation thereof is omitted.

First Embodiment

Figure 3:
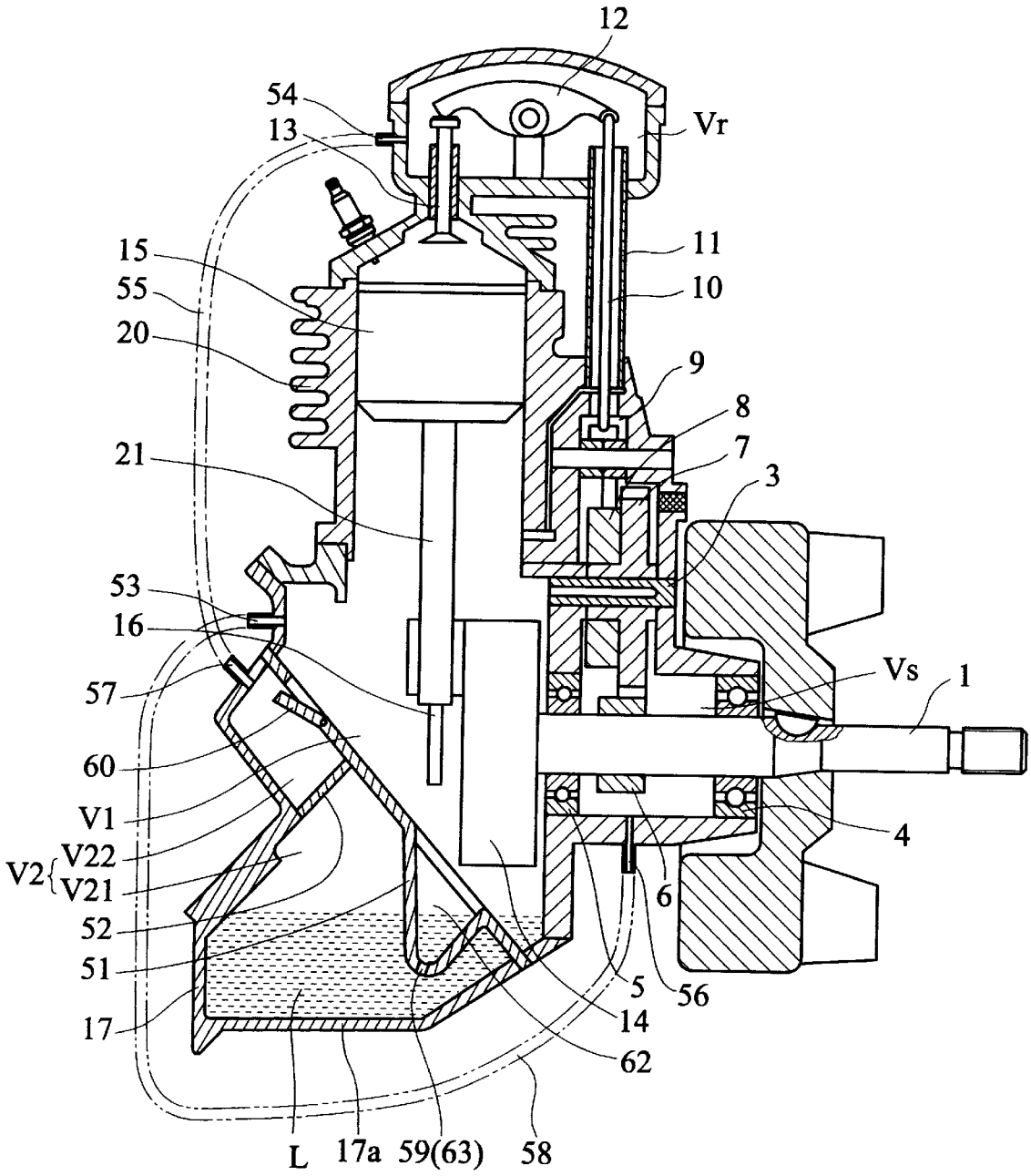
FIG. 3 is a sectional view of an engine including an improved lubricating device according to the first embodiment of the present invention operated in an upright state.

FIG. 3 is a sectional view of an engine including an improved lubricating device according to the first embodiment of the present invention in an upright state.

Figure 2:
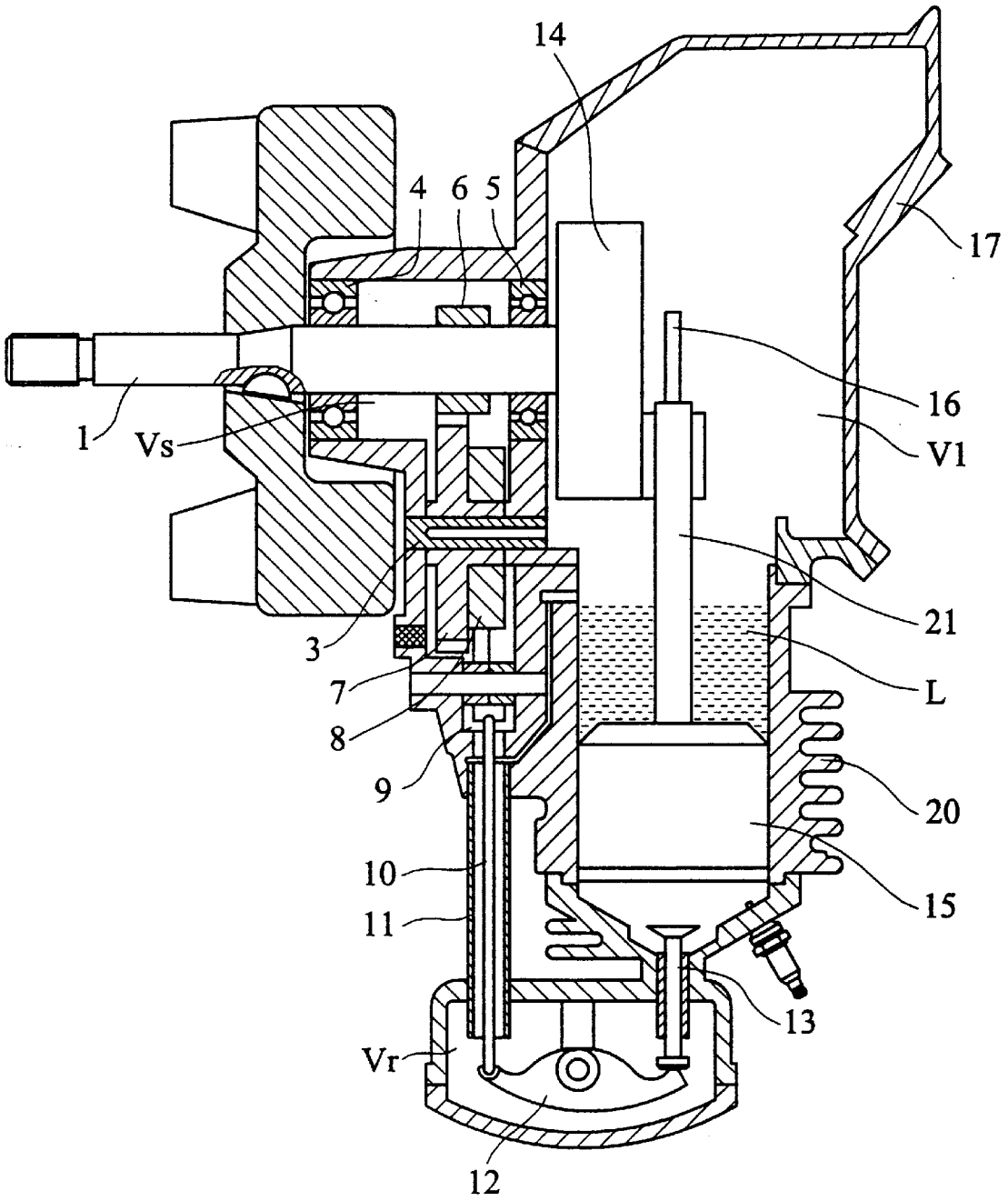
FIG. 2 (PRIOR ART)
FIG. 2 is a sectional view of a conventional four-stroke engine in an inverted state.

The main difference between the engine in FIG. 3 and the conventional engine in FIGS. 1 and 2 resides in that the lubricating device included in the FIG. 3 engine has a first partitioning portion 51 and a second partitioning portion 52 located in the lubricating oil reservoir 17. The first partitioning portion 51 divides the lubricating oil reservoir 17 into the first chamber V1 on one side of the first partitioning portion 51 opposite the bottom wall 17*a* of the lubricating oil reservoir 17, and a second chamber V2 located on the other side of the first partitioning portion 51. The second partitioning portion 52 further divides the second chamber V2 into a first sub-chamber V21 and a second sub-chamber V22. In addition, a first intake port 54, a second intake port 53, a first exhaust port 57, and a second exhaust port 56 are provided, respectively, in the walls of the rocker chamber Vr, the first chamber V1, the second sub-chamber V22, and the shaft chamber Vs for communicating the interior of each chamber Vr, V1, V22, and Vs with the exterior of engine, respectively. Further, a first conduit 55 interconnects first intake port 54 and first exhaust port 57 so as to communicate rocker chamber Vr with second sub-chamber V22. A second conduit 58 interconnects second intake port 53 and second exhaust port 56 so as to communicate first chamber V1 with shaft chamber Vs.

Figure 4A:
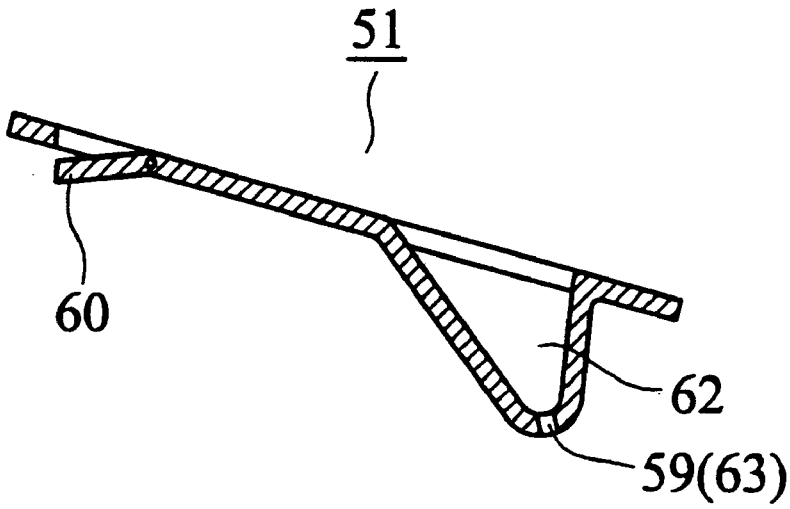
FIG. 4A is a sectional view of a first partitioning portion in the lubricating device illustrated in FIG. 3.
Figure 4B:
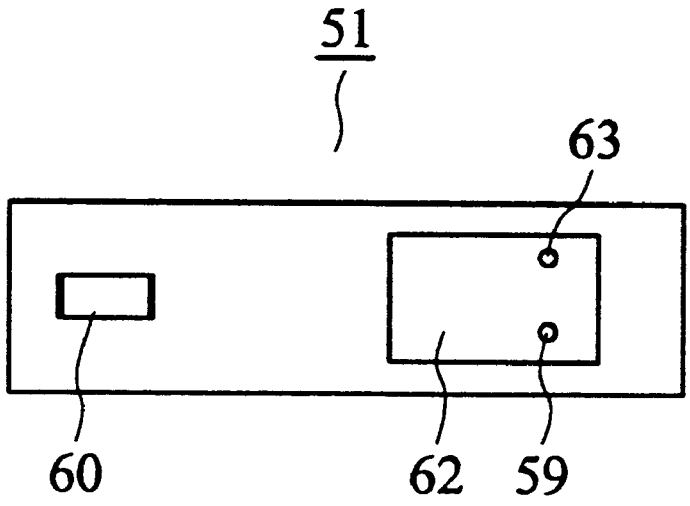
FIG. 4B is a top view of FIG. 4A.

FIG. 4A is a sectional view of the construction of the first partitioning portion 51, and FIG. 4B is the top view of FIG. 4A. Referring to FIGS. 4A and 4B, the first partitioning portion 51 includes a concave portion 62 for receiving the liquid lubricating oil L, and two openings 59 and 63, provided in the vicinity of the lowest position of the concave portion 62, which communicates the first sub-chamber V21 with the first chamber V1 so as to allow the liquid lubricating oil L to flow between these two chambers V1 and V21 shown in FIG. 3. The part of the first partitioning portion 51 surrounding the second sub-chamber 22 is provided with a check valve 60 permitting irreversible flow of lubricating oil mist L from the first chamber V1 into the second sub-chamber V22.

Referring to FIGS. 3 and 4B, the liquid lubricating oil L contained in the lubricating oil reservoir 17 may enter the concave portion 62 of the first partitioning portion 51 via the openings 59 and 63. The liquid lubricating oil L is stored in the first sub-chamber V21 and the concave portion 62 at the same level via the openings 59 and 63, as shown in FIG. 3. During the operation of the engine, the stirrer 16 splashes the liquid lubricating oil L in the concave portion 62 for lubricating the parts. The lubricating oil in the first chamber V1 is atomized into lubricating oil mist when the engine runs at a high speed.

When the piston 15 is lowered during, for example, a combustion stroke, the pressure in the first chamber V1 increases and the lubricating oil mist is forced to enter second sub-chamber V22 via check valve 60, and then enters rocker chamber Vr via first conduit 55, thereby lubricating the parts in rocker chamber Vr.

Thereafter, the lubricating oil mist in the rocker chamber Vr further flows through sleeve 11 to lubricate link 10, rocker 9, cam 8, and gear 7 etc, and then enters main shaft chamber Vs to lubricate all parts therein.

Finally, the pressure in the first chamber V1 decreases when the piston 15 is raised. The lubricating oil mist is sucked into first chamber V1 through second conduit 58. Thus, the lubricating oil mist finishes a complete circulation path, thereby ameliorating the lubricating effect.

Figure 5:
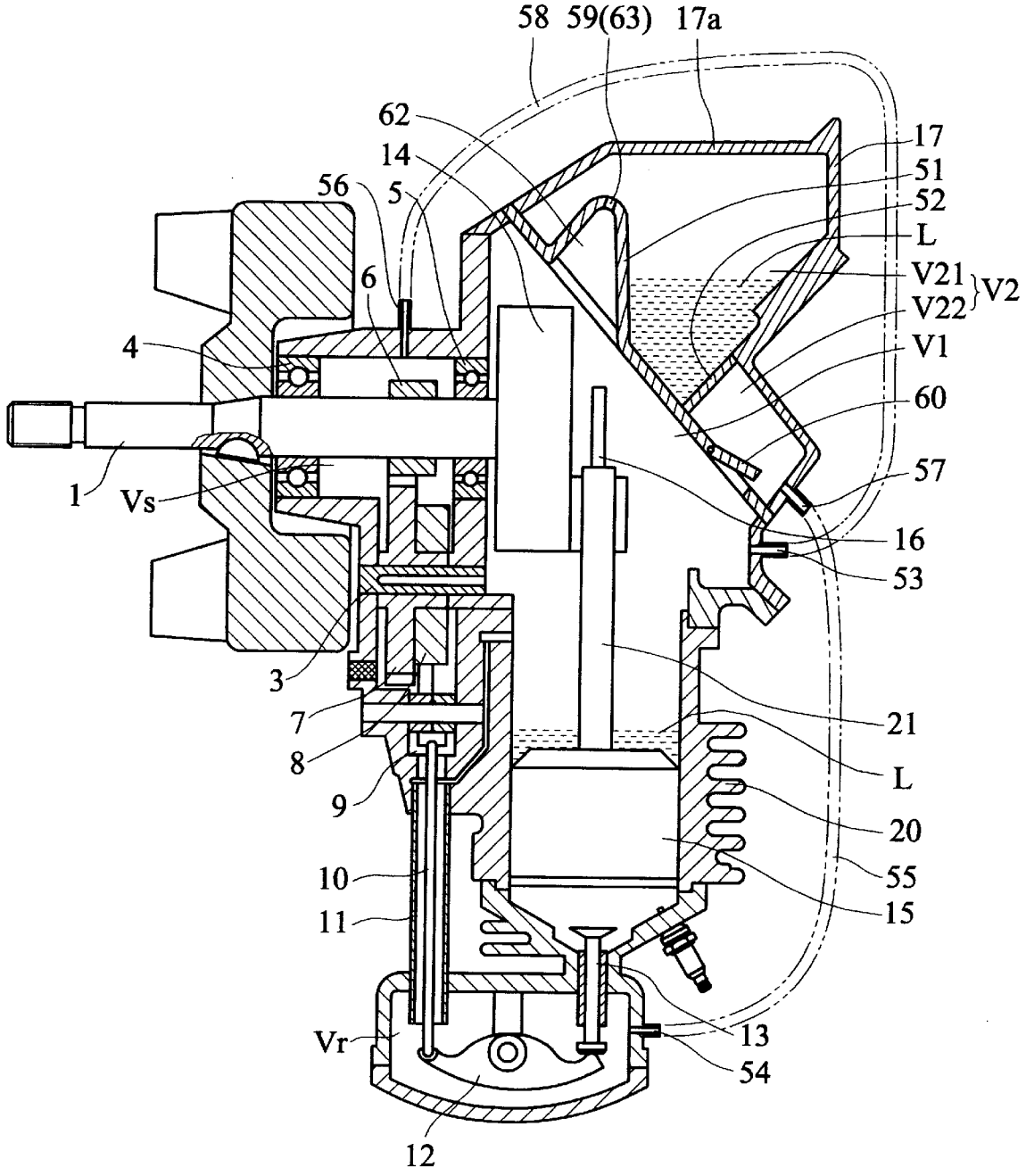
FIG. 5 is a sectional view of the same engine as in FIG. 3 except in an inverted state.

FIG. 5 is a sectional view of the same engine as in FIG. 3 except that it is shown in an inverted state. The circulation path of the lubricating oil mist is the same as that in the upright state, and will not be illustrated herein. Referring to FIG. 5, when this engine is operated in an inverted state, most of the liquid lubricating oil L flows to the region of first sub-chamber V21 surrounded by the first partitioning portion 51 and the second partitioning portion 52. Only a little liquid lubricating oil in the concave portion 62 flows towards the piston 15, causing a negligible resistance to the movement of piston 15.

Second Embodiment

Figure 6:
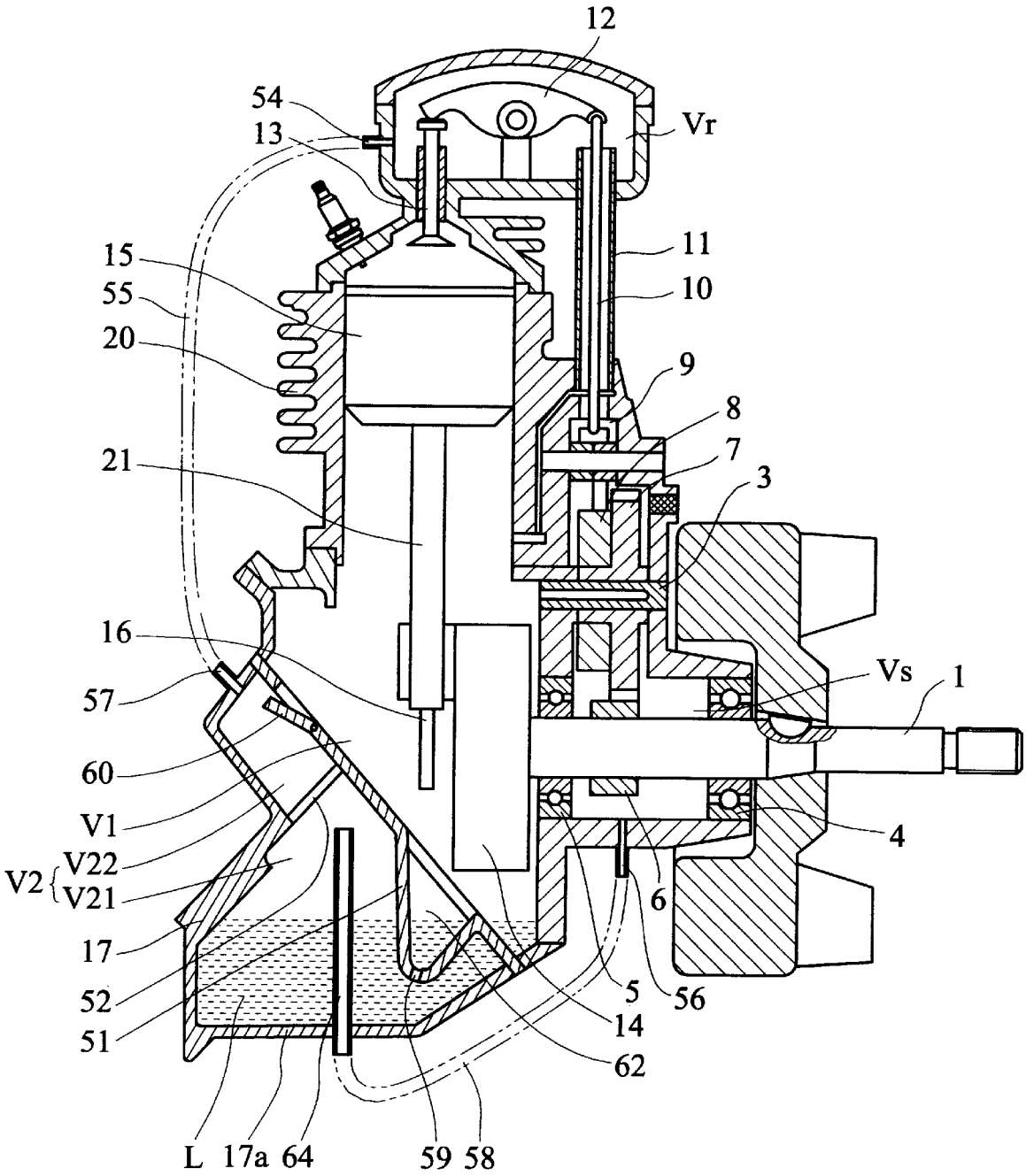
FIG. 6 is a sectional view of an engine including an improved lubricating device according to the second embodiment of the present invention operated in an upright state.
Figure 7A:
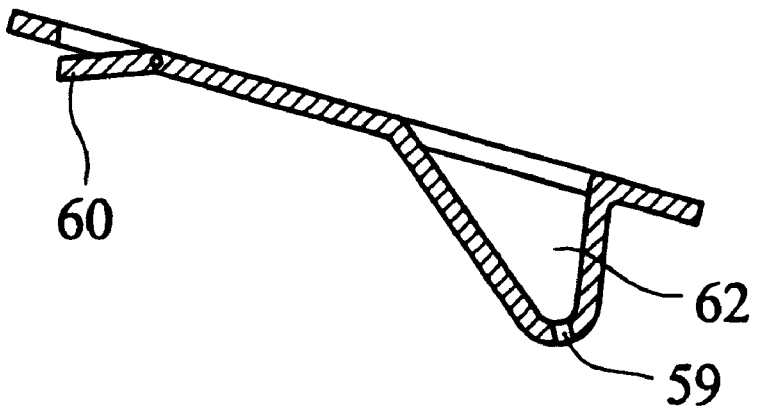
FIG. 7A is a sectional view of a first partitioning portion in the lubricating device illustrated in FIG. 6.
Figure 7B:
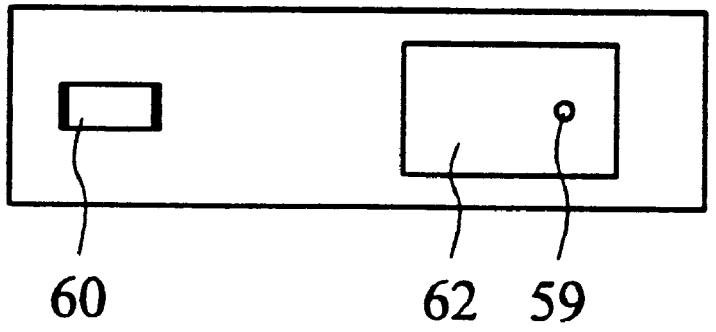
FIG. 7B is a top view of FIG. 7A.

FIG. 6 is a sectional view of an engine including an improved lubricating device according to the second embodiment of the present invention operated in an upright state. FIG. 7A is a sectional view showing a first partitioning portion in the lubricating device illustrated in FIG. 6, and FIG. 7B is a top view of FIG. 7A.

The lubricating device according to this embodiment is similar to the afore-mentioned lubricating device in the first embodiment with some exceptions to be described below.

In this embodiment, there are also provided with a first conduit 55 and a second conduit 58. The first conduit 55 communicating rocker chamber Vr with second sub-chamber V22 has identical structure with the first conduit 55 in the first embodiment, while the second conduit 58 in this embodiment is somewhat different from corresponding second conduit 58 in the first embodiment. In specific, an intake tube 64 penetrating through and held by the bottom wall 17*a* of the lubricating oil reservoir 17 is provided. This intake tube 64 has an upper end jutting out of the oil level of liquid lubricating oil L when the engine is operated in an upright state (see FIG. 6) and a lower end protruding outside of the engine. The second conduit 58 interconnects the lower end of intake tube 64 and second exhaust port 56 so as to communicate shaft chamber Vs with first sub-chamber V21.

Next, the circulation path of lubricating oil in this second embodiment will be described with reference to FIG. 6.

The liquid lubricating oil L contained in the lubricating oil reservoir 17 may enter the concave portion 62 of the first partitioning portion 51 via the opening 59. During the operation of the engine, the stirrer 16 splashes the liquid lubricating oil L in the concave portion 62 for lubricating the parts. The lubricating oil in the first chamber V1 is atomized into lubricating oil mist when the engine runs at a high speed.

When the piston 15 is lowered during, for example, a combustion stroke, the pressure in the first chamber V1 increases and the lubricating oil mist is forced to enter second sub-chamber V22 via check valve 60, and then enters rocker chamber Vr via first conduit 55, thereby lubricating the parts in rocker chamber Vr.

Thereafter, the lubricating oil mist in the rocker chamber Vr further flows through sleeve 11 to lubricate link 10, rocker 9, cam 8, and gear 7 etc, and then enters main shaft chamber Vs to lubricate all parts therein.

The pressures in rocker chamber Vr and shaft chamber Vs increase gradually every time when piston 15 is lowered. Thus, after repeating several engine cycles, the pressure in shaft chamber Vs increases to a certain extent so as to force the lubricating oil mist within shaft chamber Vs to enter first sub-chamber V21 via second conduit 58 and the intake tube 64 and mix with the liquid lubricating oil L therein. Finally, the mixed lubricating oil mist is injected into first chamber V1 through opening 59, and thus finishes a complete circulation path, thereby ameliorating the lubricating effect.

Figure 8:
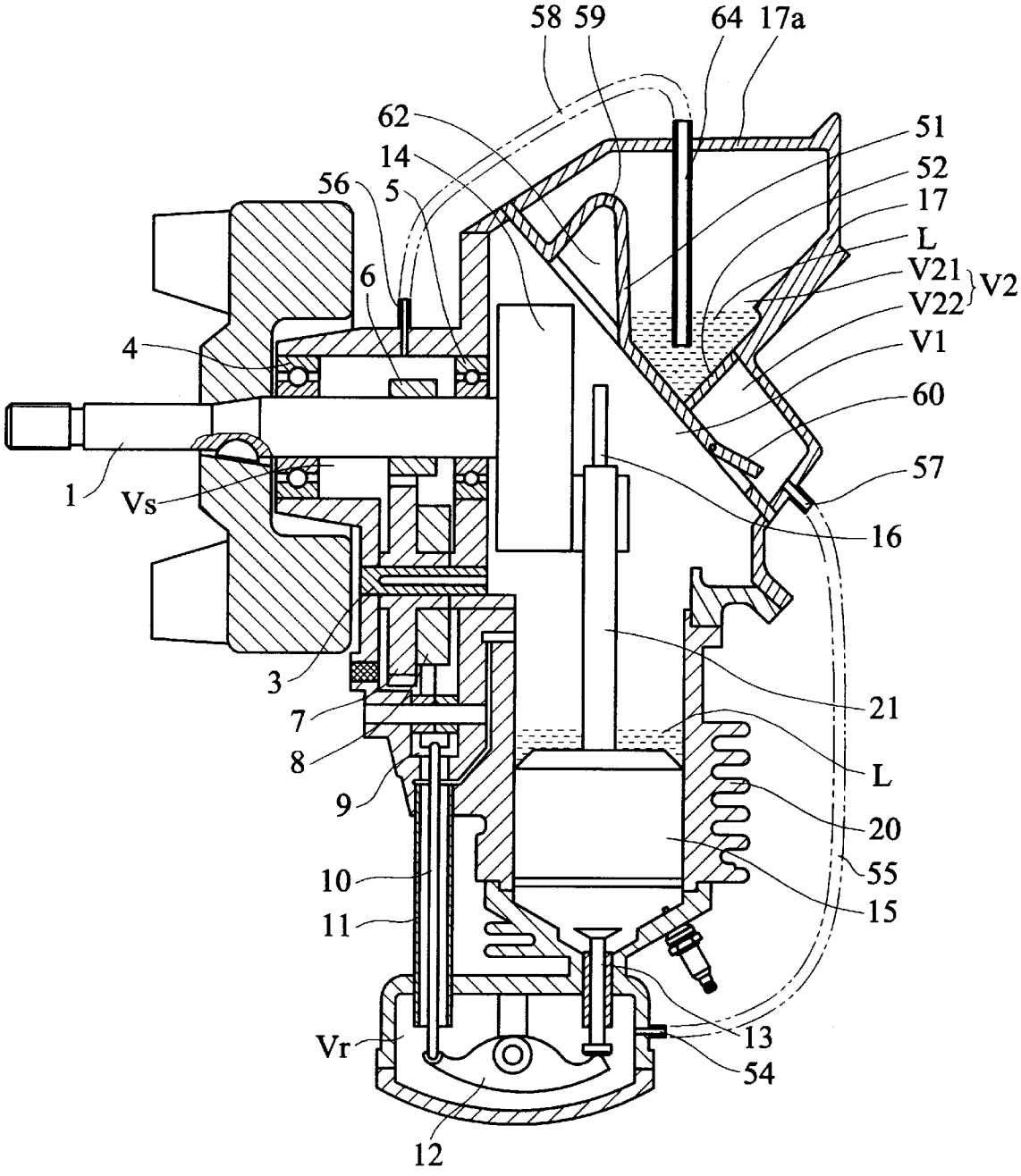
FIG. 8 is a sectional view of the same engine as in FIG. 6 except in an inverted state.

FIG. 8 is a sectional view of the same engine as in FIG. 6 except that it is shown in an inverted state. The circulation path of the lubricating oil mist is substantially the same as that in the upright state except that the substance passing through opening 59 is lubricating oil mist rather than liquid lubricating oil, and will not be illustrated herein. Referring to FIG. 8, when this engine is operated in an inverted state, most of the liquid lubricating oil L flows to the region of first sub-chamber V21 surrounded by the first partitioning portion 51 and the second partitioning portion 52. Only a little lubricating oil in the concave portion 62 flows towards the piston 15, causing a negligible resistance to the movement of piston 15.

While the preferred embodiments and examples of the present invention have been described using specific terms, such description is for illustrative purpose only, and it is to be understood that changes and modifications may be made without departing from the spirit or scope of the following claims.

What is claimed is:

1. A lubricating device for a four-stroke engine, comprising:

a lubricating oil reservoir for receiving liquid lubricating oil and lubricating oil mist;

a first partitioning portion for dividing said lubricating oil reservoir into a first chamber and a second chamber under said first chamber;

at least one concave portion formed on said first partitioning portion for receiving said liquid lubricating oil in said first chamber when the four-stroke engine is in an upright state; and at least one opening penetrating through said first partitioning portion and formed in said at least one concave portion for communicating said second chamber with said first chamber, whereby when the four-stroke engine is in said upright state, said liquid lubricating oil is stored in said second chamber and said at least one concave portion at the same level via said at least one opening.

2. The lubricating device according to claim 1, further comprising a second partitioning portion for dividing said second chamber into a first sub-chamber containing said liquid lubricating oil and a second sub-chamber over said second chamber without said liquid lubricating oil therein, whereby when the four-stroke engine is in an upright state, said liquid lubricating oil is stored in said first sub-chamber and said at least one concave portion at the same level via said at least one opening.

3. The lubricating device according to claim 2, further comprising:

only one check valve provided in a part of said first partitioning portion contacting with said second sub-chamber, which permits an irreversible flow only of said lubricating oil mist from said first chamber into said second sub-chamber;

a first conduit for communicating said second sub-chamber with a rocker chamber over said first chamber; and a second conduit for communicating said first chamber with a main shaft chamber adjacent to said first chamber.

4. The lubricating device according to claim 2, further comprising:

only one check valve provided in the part of said first partitioning portion contacting with said second sub-chamber, which permits an irreversible flow only of said lubricating oil mist from said first chamber into said second sub-chamber;

a first conduit for communicating said second sub-chamber with a rocker chamber over said first chamber;

an intake tube inserting into said lubricating oil reservoir in said first sub-chamber, said intake tube having a first end jutting out of the level of said liquid lubricating oil when the four-stroke engine is operated in said upright state and a second end outside said lubricating oil reservoir; and a second conduit for communicating said second end of said second intake tube with a main shaft chamber adjacent to said first chamber.

5. The lubricating device of claim 3, wherein said at least one concave portion opens to a crankcase chamber to provide a small predetermined quantity of lubricating oil in the crankcase chamber to lubricate the piston when the engine is inverted.

* * * * *